United States Patent [19]

Atago et al.

[11] Patent Number: 4,510,907

[45] Date of Patent: Apr. 16, 1985

[54] ELECTRONIC CONTROL SYSTEM FOR CONTROLLING AIR-FUEL RATIO IN AN INTERNAL COMBUSTION ENGINE

[75] Inventors: Takeshi Atago; Toshio Manaka, both of Katsuta, Japan

[73] Assignee: Hitachi, Ltd., Tokyo, Japan

[21] Appl. No.: 377,420

[22] Filed: May 12, 1982

[30] Foreign Application Priority Data

May 19, 1981 [JP] Japan ..... 56-74170

[51] Int. Cl.[3] ..... F02M 7/10

[52] U.S. Cl. ..... 123/435; 123/440

[58] Field of Search ..... 123/435, 436, 438, 440, 123/489, 589, 179 G

[56] References Cited

U.S. PATENT DOCUMENTS

| | | | |
|---|---|---|---|
| 4,290,107 | 9/1981 | Suda et al. | 123/440 |
| 4,364,357 | 12/1982 | Matsuoka | 123/440 |
| 4,373,187 | 2/1983 | Ishii et al. | 123/440 |
| 4,380,985 | 4/1983 | Otsuka et al. | 123/589 |
| 4,411,232 | 10/1983 | Atago et al. | 123/440 |
| 4,426,976 | 1/1984 | Tanahashi et al. | 123/440 |

*Primary Examiner*—Parshotam S. Lall
*Assistant Examiner*—W. R. Wolfe
*Attorney, Agent, or Firm*—Antonelli, Terry & Wands

[57] ABSTRACT

There is disclosed an electronic control system for controlling a carburetor equipped with a slow-main system solenoid valve and an enrichment system solenoid valve of different control ranges whose openings are electromagnetically controlled to control the air-fuel ratio of a mixture supplied to an internal combustion engine. The control system calculates, based on signals representative of the engine operating condition including engine temperature, the duty for control of the slow-main system solenoid valve in accordance with the air-fuel ratio required for various engine operating states. When the value of this duty exceeds a predetermined value, the enrichment system solenoid valve is added to the slow-main system solenoid valve to accurately control the air-fuel ratio over a wide range.

10 Claims, 6 Drawing Figures

ELECTRONIC CONTROL SYSTEM FOR CONTROLLING AIR-FUEL RATIO IN AN INTERNAL COMBUSTION ENGINE

BACKGROUND AND SUMMARY OF THE INVENTION

This invention relates to an air-fuel ratio control system for an internal combustion engine and more particularly to an electronic air-fuel ratio control system capable of accurately controlling the air-fuel ratio in accordance with the engine operating condition.

U.S. Pat. No. 4,290,107 (filed May 25, 1979), for example, proposes a so-called electronically controlled carburetor which can substitute for the conventional carburetor for mechanically controlling the air-fuel ratio. According to this proposal, a great number of parameters representative of the engine operating states are fetched to finely control the air-fuel ratio.

Even in such an electronically controlled carburetor, however, the air-fuel ratio of a mixture supplied to an internal combustion engine is finally controlled by, for example, a main solenoid and a slow solenoid that control valves electromagnetically. Control characteristics obtained by these solenoids have a stable control zone around a central ON-duty of 50% and dead zones near ON-duties of 0% and 100%, resulting in difficulties encountered in accurately controlling the air-fuel ratio over a wide control range.

It is an object of this invention to provide an electronic air-fuel ratio control system which can eliminate the conventional drawbacks and accurately control the air-fuel ratio over a wide control range.

According to this invention, in an electronic control system for controlling a carburetor equipped with first and second control means of different control ranges whose openings are electromagnetically controlled to control the air-fuel ratio of a mixture supplied to an internal combustion engine, the first and second control means of the carburetor are controlled in accordance with an air-fuel ratio required dependent on an engine operating state, the required air-fuel ratio is compared with a predetermined value, and a comparison result decides whether the first control means or the first and second control means of the carburetor control the air-fuel ratio.

Specifically, the air-fuel control system of this invention can steadily control the air-fuel ratio upon start and warming-up operation of the engine.

BRIEF DESCRIPTION OF THE DRAWINGS

The present invention will be apparent from the following detailed description taken in conjunction with the accompanying drawings, in which.

DESCRIPTION OF THE DISCLOSED EMBODIMENT

Figure 1:
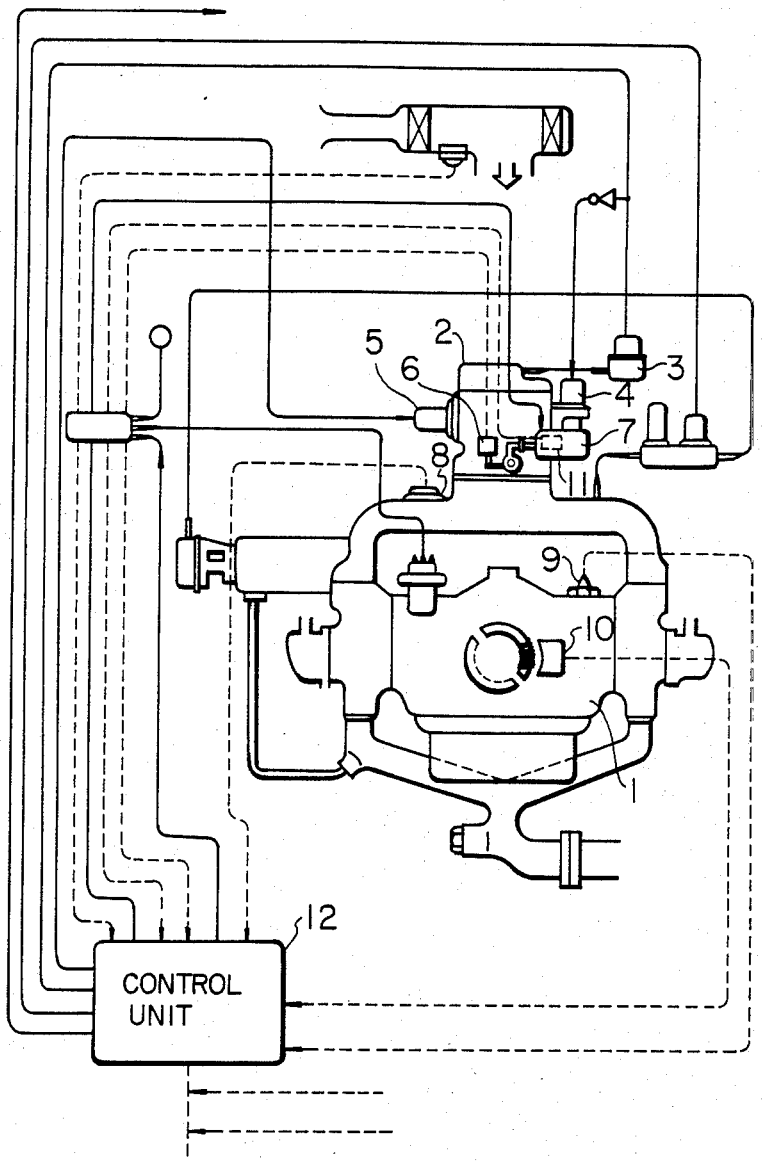
FIG. 1 is a block diagram showing an internal combustion engine with an electronic air-fuel ratio control system according to the invention.

Referring now to FIG. 1, there are illustrated an engine 1, a carburetor 2, a slow solenoid valve 3, a main solenoid valve 4, a fuel solenoid valve 5, a limit switch 6, a throttle actuator 7, an intake negative pressure sensor 8, a cooling water temperature sensor 9, a pulse type engine revolution sensor 10, an idling detecting switch 11, and control unit 12.

Figure 2:
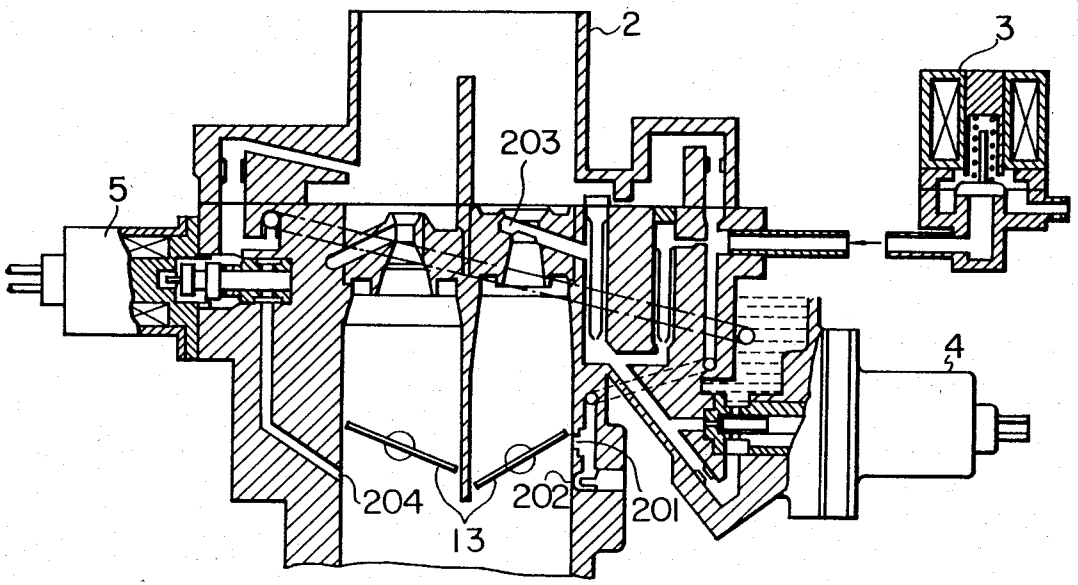
FIG. 2 is a sectional view showing one embodiment of a carburetor controlled by the electronic control system of the invention.

The carburetor 2 and solenoid valves 3 to 5 associated therewith are constructed as shown in FIG. 2.

More particularly, the slow solenoid valve 3 controls air in a slow air bleed so as to control the amount of fuel supplied to a slow port 201 and an idling port 202 of the carburetor 2, and the main solenoid valve 4 controls the amount of fuel supplied to a main nozzle 203. The fuel solenoid valve 5 controls the amount of fuel supplied to a by-pass air path 204 in communication with a throttle valve 13.

Accordingly, by controlling the slow solenoid valve 3 and the main solenoid valve 4, the air-fuel ratio A/F in the main-slow system of the carburetor 2 can be controlled whereas by controlling the fuel solenoid valve 5, the air-fuel ratio A/F in the enrichment system of the carburetor 2 can be controlled.

Figure 3:
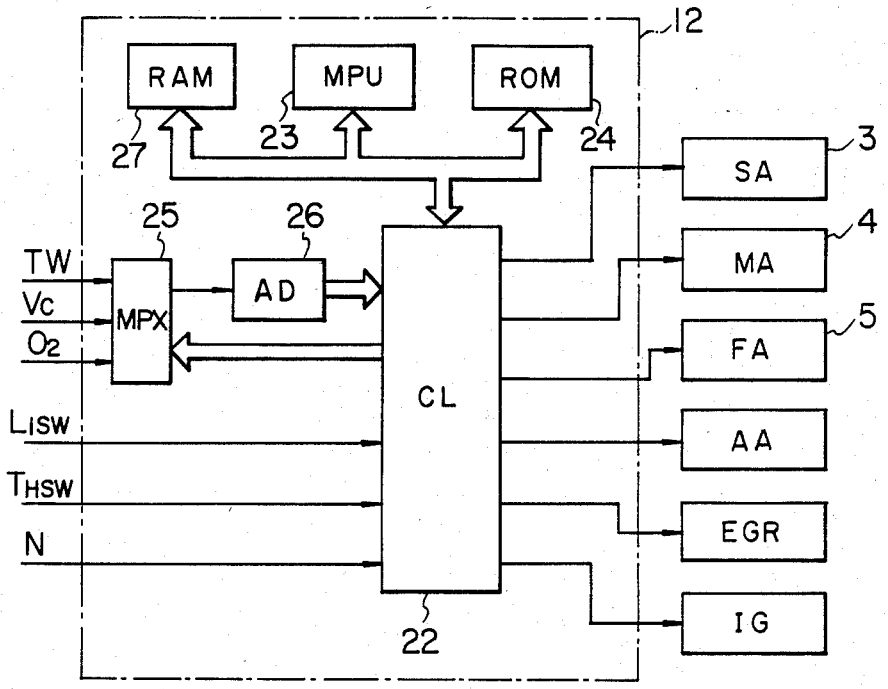
FIG. 3 is a block diagrm illustrating one embodiment of a control unit shown in FIG. 1.

The control unit 12 as exemplified in FIG. 3 comprises a control logic 22, a microprocessor 23, a ROM 24, a multiplexer 25, and an analog to digital converter 26. The control logic 22 fetches analog data, such as an intake negative pressure $V_C$ from the negative pressure sensor 8 (shown in FIG. 1), an engine temperature $T_W$ from the water temperature sensor 9 (shown in FIG. 1) and an output signal $O_2$ from an oxygen sensor (not shown) for detecting the oxygen concentration in exhaust gas, through the multiplexer 25 and analog to digital converter 26. Also, the control logic 22 directly fetches digital data such as a data $L_{iSW}$ from the limit switch 6 (shown in FIG. 1), a data $T_{HSW}$ from the idling detecting switch 11 (shown in FIG. 1) and an engine revolution N from the engine revolution sensor 10 (shown in FIG. 1). The thus fetched signals and data are arithmetically processed by the microprocessor 23, ROM 24 and RAM 27 for control of various actuators such as slow solenoid valve 3, main solenoid valve 4, fuel solenoid valve 5 and throttle actuator 7, thereby ensuring that an optimum air-fuel ratio A/F in accordance with the engine operating condition can be obtained.

Accordingly, the air-fuel ratio control system constructed as above responds to various data representative of engine operating states to optimize the air-fuel ratio A/F under the steady operating condition by controlling the slow and main solenoid valves 3 and 4, to optimize the air-fuel ratio A/F under the warm-up operating condition by controlling the fuel solenoid valve 5, and to optimize the amount of fuel supplied to the engine under the idling condition and the standstill warming-up condition by controlling the throttle actuator 7.

To control the opening of the solenoid valves 3, 4 and 5, the so-called ON/OFF duty control is employed in which the solenoid valve is operated on the basis of a constant period T and for an ON-time t within each period T, it is opened. Therefore, the opening can be controlled by changing the ratio of ON-time t to period T or t/T. A value as defined by $t/T \times 100(\%)$ is called an On-duty. Since the air-fuel ratio A/F in the slow-main system can be controlled as shown at a characteristic A in FIG. 4 by controlling the ON-duty of the slow and main solenoid valves 3 and 4 and the air-fuel ratio A/F in the enrichment system can be controlled as shown at a characteristic B in FIG. 4 by changing the ON-duty of the fuel solenoid valve 5, the air-fuel ratio A/F can be controlled by the control unit 12.

Thus, the electronic air-fuel ratio control system which can always optimize the air-fuel ratio through the fine controlling in accordance with the engine operating condition has widely been used in control apparatus for automobile engines.

In this type of electronic air-fuel ratio control system, the air-fuel ratio A/F is controlled by the solenoid valves 3 and 4 of the slow-main system in the steadly operation zone in which the engine temperature exceeds a predetermined value whereas in the warming-up operation zone in which the engine temperature is low and enrichment of the air-fuel ratio A/F is required, the air-fuel ratio A/F is controlled by the solenoid valve 5 of the enrichment system. Accordingly, specifications of the carburetor are determined so that both the characteristic A by the solenoid valves 3 and 4 of the slow-main system and the characteristic B by the fuel solenoid valve 5 as shown in FIG. 4 may be obtained.

Conventionally, in order to keep the control characteristic by the solenoid valves 3 and 4 excellent near an air-fuel ratio A/F of about 15 which corresponds to the stoichiometric air-fuel ratio A/F, it is managed to obtain the approximately 15 air-fuel ratio A/F near 50% ON-duty for the solenoid valves 3 and 4. Accordingly, while the air-fuel ratio control by the solenoid valves 3 and 4 of the slow-main system is mainly effected only near the 15 air-fuel ratio, the air-fuel ratio control in a zone such as the warm-up operation zone in which the air-fuel ratio is less than the stoichiometric air-fuel ratio is mainly effected by only the fuel solenoid valve 5.

However, as will be seen from the characteristic B in FIG. 4, since the control range by the fuel solenoid valve 5 is rather adapted for covering a zone in which the air-fuel ratio A/F is small, the ON-duty for the fuel solenoid valve 5 is below ten and several % for an extremity of an increased air-fuel ratio which approximates about 15 air-fuel ratio or the stoichiometric air-fuel ratio. Then, the overall control characteristics by the solenoid valves 3 to 5 consist of stable zones around the 50% ON-duty and non-linear unstable zones containing dead zones near 0% ON-duty and 100% ON-duty, as shown in FIG. 4.

Figure 4:
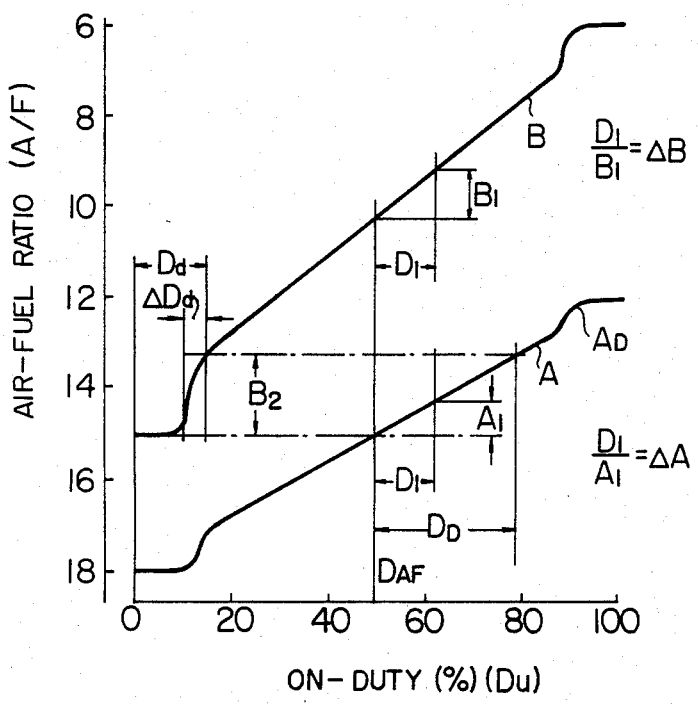
FIG. 4 is a graph showing characteristics of a slow-main system solenoid valve and an additional enrichment system solenoid valve of the carburetor shown in FIG. 2.

It will be appreciated that although the slow solenoid valve 3 and the main solenoid valve 4 are separately equipped to the carburetor 2 as shown in FIG. 3 and they are controlled separately, they can be considered unitary from the standpoint of performance of the carburetor as well known in the art and hence characteristics by the solenoid valves 3 and 4 merge in the characteristic A in FIG. 4.

When reviewing the characteristic A in FIG. 4, it will be seen that the air-fuel ratio A/F changes by 6 between 0% ON-duty and 100% ON-duty for the slow-main solenoid valves 3 and 4, and that the air-fuel ratio A/F changes by $A_1$ as the On-duty changes by a unit for $D_1$. Also, as described previously, these solenoid valves 3 and 4 are adapted to control the air-fuel ratio to about 15 of the stoichiometric air-fuel ratio and their control is effected with respect to a reference On-duty $D_{AF}$ near 50% ON-duty. This ON-duty $D_{AF}$ slightly varies dependent on precision of finishing of the carburetor and engine operating condition but it provides an approximately constant air-fuel ratio of 15 in the normal operation zone. Accordingly, the solenoid valves 3 and 4 are controlled with respect to the reference ON-duty as explained above.

In the characteristic B for the fuel solenoid valve 5, the air-fuel ratio A/F changes by $B_1$ as the ON-duty changes by a unit of $D_1$. Therefore, the change $A_1$ in the air-fuel ratio with respect to the change $D_1$ in the ON-duty for the slow-main solenoid valves 3 and 4 can be obtained by changing the air-fuel ratio by means of the fuel solenoid valve 5 by an ON-duty of $D_1 \times A_1/B_1$.

The characteristics A and B also show that, as explained previously, the operation of the slow-main solenoid valves 3 and 4 and the fuel solenoid valve 5 rises with a delay of Dd and exhibits non-linear characteristics near 0% ON-duty and 100% ON-duty. Especially, since in the slow-main solenoid valves 3 and 4 the control range is confined to the proximity of the reference ON-duty $D_{AF}$ and the value of $A_1$ is relatively small, a partial characteristic as indicated by $A_D$ is not so serious. In contrast, it is difficult in the case of the fuel solenoid valve 5 to accurately control the air-fuel ratio since the ON-duty is controlled, starting from 0%, and within a partial characteristic Dd, the air-fuel ratio changes abruptly by $B_2$ as the ON-duty slightly changes by $\Delta Dd$.

Accordingly, in accordance with one embodiment of this invention, the range of the ON-duty between 0% and Dd is inhibited for the solenoid valve 5.

Figure 5:
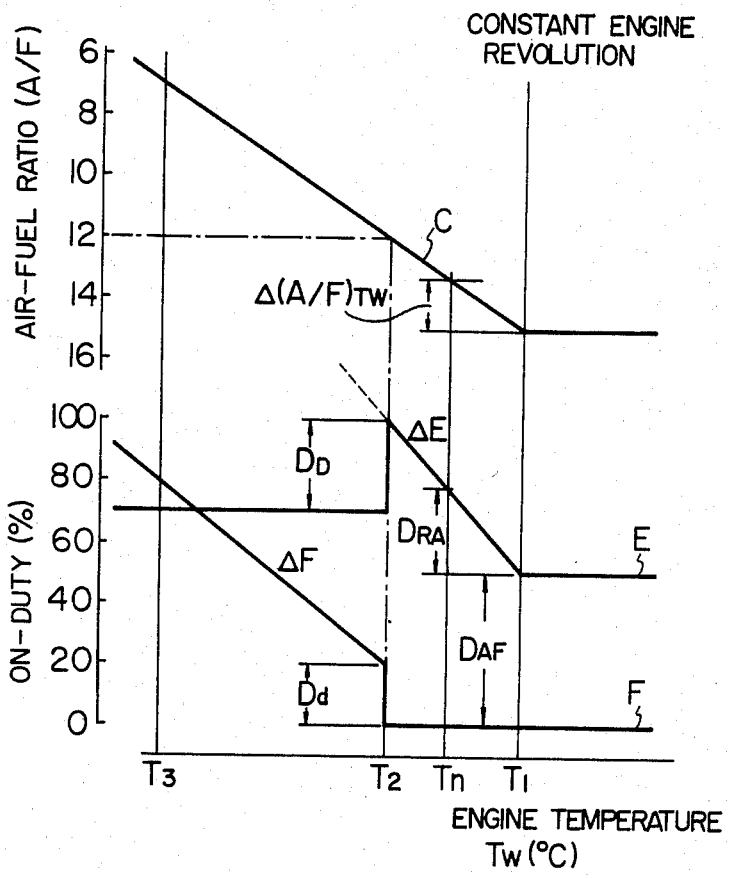
FIG. 5 is a graph showing operation characteristics of the air-fuel ratio control system shown in FIG. 1.

Referring now to FIG. 5, the operation of the air-fuel ratio control system embodying the invention will be described.

In FIG. 5, abscissa represents the engine temperature $T_W$, and a characteristic C shows the air-fuel ratio A/F optimized with respect to the engine temperature $T_W$ wherein the required control is such that the air-fuel ratio A/F is kept constant at 15 for the engine temperature $T_W$ being above a temperature $T_1$, for example, 80° C. and for the engine temperature $T_W$ being below the temperature $T_1$, the air fuel ratio A/F is decreased linearly as the engine temperature decreases.

A characteristic E shows the ON-duty, $D_A$, which must be applied to the slow-main solenoid valves 3 and 4 in order to optimize the air-fuel ratio A/F to the characteristic C. According to the characteristic E, the ON-duty $D_A$ is kept constant at $D_{AF}$ sympathetically with the characteristic C when the engine temperature $T_W$ exceeds the temperature $T_1$, and it is increased linearly to enrich the air-fuel ratio A/F as the engine temperature $T_W$ decreases below the temperature $T_1$. In the linear decrease of the characteristic E, the gradient, $\Delta E$, corresponds to $D_1/A_1$ or $\Delta A$ as explained in with reference to FIG. 4. Assuming that a change in the ON-duty $D_A$ which is determined by the gradient $\Delta E$ at an engine temperature $T_n$ is $D_{RA}$, the change $D_{RA}$ is used to provide, on the characteristic C, a difference $\Delta(A/F)T_W$ between a value of air-fuel ratio $(A/F)T_W$ at the temperature $T_W$ and the about 15 air-fuel ratio determined by the ON-duty $D_{AF}$. Accordingly, $\Delta(A/F)T_W = 15 - (A/F)T_W$ stands and the ON-duty $D_A$ for the slow-main solenoid valves 3 and 4 required to obtain the air-fuel ratio $(A/F)T_W$ at the temperature $T_n$ is $D_{AF}+D_{RA}$.

In this manner, for the engine temperature $T_W$ being below $T_1$, the ON-duty $D_A$ for the solenoid valves 3 and 4 of the slow-main system is increased at the gradient $\Delta E$ from the $D_{AF}$ at the temperature $T_1$ until the ON-duty $D_A$ reaches 100% at an engine temperature $T_2$. Then, for the engine temperature being below $T_2$, the ON-duty $D_A$ is fixed at a constant value of $(100-D_D)$, where $D_D$ is a predetermined value to be described later which is related to the unstable partial characteristic Dd of the fuel solenoid valve 5 as explained with reference to FIG. 4.

Finally, a characteristic F shows the ON-duty, $D_B$, for the fuel solenoid valve 5 which is required to optimize the air-fuel ratio A/F to the characteristic C. According to the characteristic F, in a zone of the engine temperature $T_W$ being above $T_2$ in which the ON-duty $D_A$ for the slow-main solenoids 3 and 4 remains below 100%, the ON-duty $D_B$ is fixed at 0%, and this ON-duty $D_B$ is changed by Dd equal to the unstable partial characteristic Dd on the ON-duty characteristic B as shown in FIG. 4 when the engine temperature falls to the temperature $T_2$ and thereafter it is increased linearly at a gradient $\Delta F$ as the engine temperature $T_W$ decreases so as to enrich the air-fuel ratio. The gradient $\Delta F$ of the characteristic F corresponds to $D_1/B_1$ or $\Delta B$ in FIG. 4.

As described above, in the foregoing embodiment adapted for controlling the air-fuel ratio A/F to the characteristic C in accordance with the engine temperature $T_W$ so as to constantly optimize the air-fuel ratio A/F, the air-fuel ratio A/F is controlled by the solenoid valves 3 and 4 of the slow-main system when the engine temperature exceeds the predetermined temperature $T_2$ and it is controlled by the solenoid valves 3 and 4 of the slow-main system and the additional fuel solenoid valve 5 to enrich the air-fuel ratio A/F when the engine temperature falls below the predetermined temperature $T_2$. In addition, as soon as the ON-duty $D_B$ for the fuel solenoid valve 5 is ready to change from 0% to a finite value at the temperature $T_2$, it is changed immediately by a first predetermined value Dd so that the air-fuel ratio control based on the unstable partial characteristic of the fuel solenoid valve 5 can be inhibited. Concurrently therewith, the ON-duty $D_A$ for the slow-main solenoid valves 3 and 4 is decreased by a second predetermined value $D_D$ to ensure that the control of the air-fuel ratio A/F can always be optimized and made stable over the wide range of changes in the engine temperature Tw.

The second predetermined value $D_D$ can be determined as will be described below.

The ON-duty $D_B$ abruptly changes by Dd at the temperature $T_2$ to make the operation of the fuel solenoid valve 5 escape from the unstable partial characteristic. As a result, however the air-fuel ratio A/F changes stepwise by $B_2$ shown in FIG. 4. Therefore, to assure a continuous change of the air-fuel ratio around the temperature $T_2$, it is necessary to change the ON-duty $D_A$ for the slow-main solenoid valves 3 and 4 stepwise in the opposite direction. The second predetermined value $D_D$ will therefore be determined so as to allow the slow-main solenoid valves 3 and 4 to cancel the abrupt change $B_2$ in the air-fuel ratio caused by the fuel solenoid valve 5. As the first predetermined value $D_d$ is fixed dependent on the characteristic of the fuel solenoid valve 5, so the second predetermined value $D_D$ is fixed.

Figure 6:
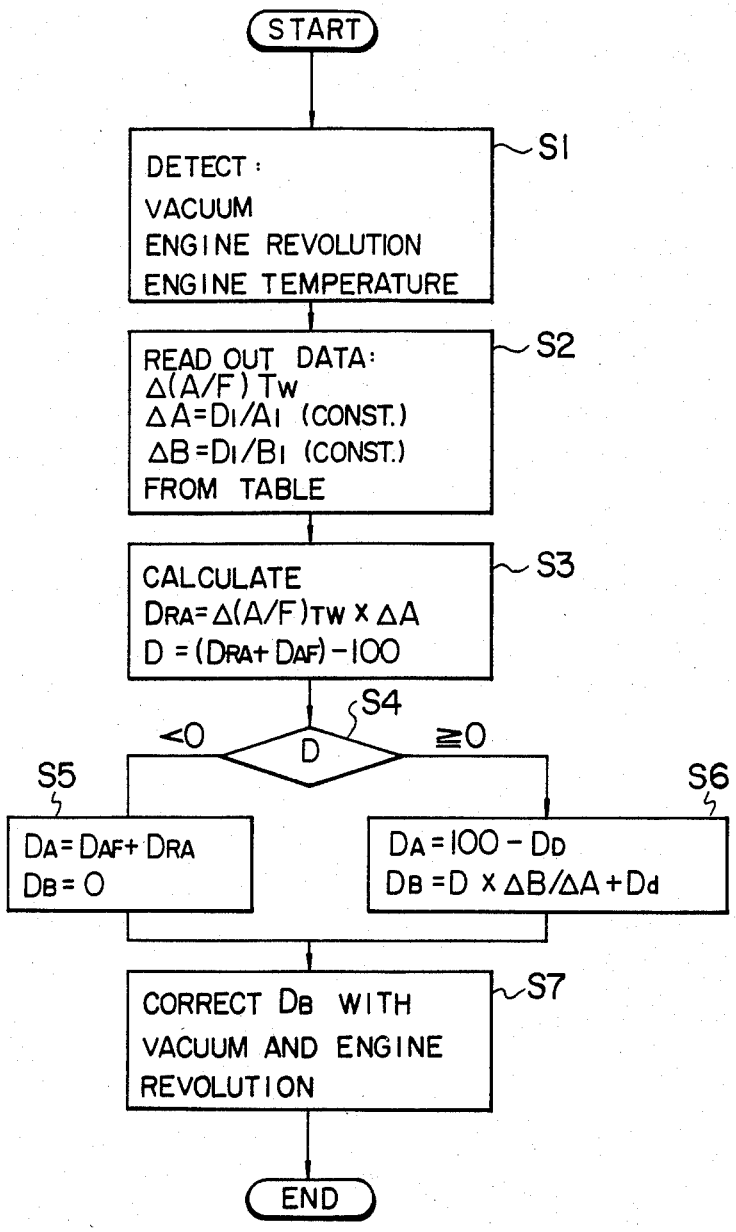
FIG. 6 is a flow chart for explaining the operation of the control unit of air-fuel ratio control system shown in FIG. 3.

Exemplified in FIG. 6 is a flow chart for implementation of the characteristics shown in FIG. 5. The flow chart in the form of a program of a microcomputer included in the control unit 12 is executed periodically to control the slow-main solenoid valves 3 and 4 as well as the fuel solenoid valve 5 in accordance with the characteristics shown in FIG. 5.

In the embodiment of FIG. 6, individual steps in the flow chart are designated by $S_1$ to $S_7$.

When the control operation pursuant to the flow chart is started, signals representative of various engine operating states including the engine temperature Tw from the cooling water sensor 9 (FIG. 1) are first fetched in step $S_1$.

In step $S_2$, the table retrieval is effected on the basis of the engine temperature Tw to determine the difference data $\Delta(A/F)$ Tw between a value of required air-fuel ratio and 15, $\Delta A=\Delta E=D_1/A_1$, and $\Delta B=\Delta F=D_1/B_1$ in accordance with the characteristic C in FIG. 5.

Then, in step $S_3$, the data $D_{RA}$ required for the characteristic E in FIG. 5 is determined by calculating $\Delta(A/F)$ Tw$\times\Delta A$, and the discrimination data D is determined by calculating $(D_{RA}+D_{AF})-100$ based on the data $D_{RA}$ and $D_{AF}$ (as described previously, the $D_{AF}$ being the so-called reference ON-duty data necessary for the slow-main solenoid valves 3 and 4 to provide the stoichiometric air-fuel ratio of 15).

Subsequently, in step $S_4$, the discrimination data D is examined as to whether it is positive or negative. If negative $(D<0)$, $(D_{RA}+D_{AF})$, namely, a value of the ON-duty $D_A$ to be applied to the slow-main solenoid valves 3 and 4 at the present engine temperature Tw has not yet reached 100%, indicating that the present engine temperature Tw is higher than the temperature $T_2$ in FIG. 5 and hence the air-fuel ratio A/F must be controlled by only the slow-main solenoid valves 3 and 4. Accordingly, step $S_5$ is traced in which the ON-duty $D_A$ for the slow-main solenoid valves 3 and 4 is set to $D_{AF}+D_{RA}$ whereas the ON-duty $D_B$ for the fuel solenoid valve 5 is kept at 0 (zero).

On the other hand, if the discrimination data D is found to be positive as a result of the examination in step $S_4$, indicating that $(D_{RA}+D_{AF})$ has exceeded 100% and the present engine temperature Tw is below the temperature $T_2$ in FIG. 5, step $S_6$ is traced in which the ON-duty $D_A$ for the slow-main solenoid valves 3 and 4 is calculated in terms of $D_A=100-D_D$ and the ON-duty $D_B$ for the fuel solenoid valve 5 is then calculated in terms of $D_B=D\times\Delta B/\Delta A+Dd$.

Consequently, in the zone in which the engine temperature Tw is higher than the temperature $T_2$ and hence relatively reduced enrichment of the air-fuel ratio is sufficient, namely, in which the level of the ON-duty $D_A$ serving as the operation signal for the solenoid valves 3 and 4 of the slow-main system does not reach a predetermined level of, for example, 100%, the air-fuel ratio A/F is controlled by only the solenoid valves 3 and 4 of the slow-main system; whereas in the zone in which the engine temperature Tw is lower than the temperature $T_2$ and hence increased enrichment of the air-fuel ratio is required, namely, in which the ON-duty $D_A$ is so calculated as to exceed 100%, the fuel solenoid valve 5 participates in the air-fuel control in addition to the solenoid valves 3 and 4 of the slow-main system and the air-fuel ratio control is effected by fuel supplied from both the systems. In this manner, the control operation pursuant to the characteristics E and F in FIG. 5 can be implemented.

And, the ON-duty $D_B$ for the fuel solenoid valve 5 assumes the first predetermined value Dd at the temperature $T_2$, thus making the air-fuel ratio control be free from unstableness and uncertainty.

In the embodiment of FIG. 6, step $S_6$ is followed by step $S_7$ in which the ON-duty $O_B$ is corrected by the engine revolution N and the intake negative pressure $V_C$ prior to ending the flow. This correction is inserted in consideration of the fact that the fuel solenoid valve 5 is disposed in the air passage for biasing the throttle valve 13 as shown in FIG. 2 and the characteristics of the air-fuel ratio control are influenced by the data representative of N and Vc to a great extent. In accordance with the FIG. 6 embodiment, therefore, the air-fuel ratio can always be controlled accurately irrespective of changes in the engine revolution and intake back pressure.

As has been described, according to this invention, the air-fuel ratio is controlled by the doubled supply of fuel from the slow-main system and the additional enrichment system when the engine temperature is low and the enrichment of the air-fuel ratio A/F is required, thereby providing the electronic air-fuel ratio control system which can assure the stable and accurate control operation over the wide range of the engine temperature and eliminate the prior art drawbacks.

We claim:

1. An electronic control system for controlling a carburetor equipped with first control means for a slow main system and second control means for an enrichment system, said first and second control means having different control ranges and respective openings which are electromagnetically controlled to control the air-fuel ratio of a mixture supplied to an internal combustion engine, said system comprising:

means for generating signals representative of the engine operating states including at least that an engine temperature is below a predetermined value;

a control unit receiving the signals representative of the engine operating states from said signal generating means and reading data regarding the air-fuel ratio required dependent on the engine operating states to generate control signals for controlling the first and second control means of the carburetor; and means responsive to the control signals from said control unit to generate drive signals for driving the first and second control means of the carburetor;

said control unit being constructed such that the data regarding the required air-fuel ratio is compared with a predetermined value, the comparison results determining whether the first control means or the first and second control means of the carburetor control the air-fuel ratio, and the control signal necessary for controlling the corresponding control means of the carburetor is generated on the basis of the comparison result.

2. An electronic control system according to claim 1 wherein said control unit controls the air-fuel ratio by the first control means of the carburetor when the comparison result of the data regarding the air-fuel ratio with the predetermined value is negative and by the first and second control means when said comparison result is positive.

3. An electronic control system according to claim 1 wherein said control unit is responsive to the difference between the air-fuel ratio required dependent on the engine operating states and the predetermined value to fetch the data regarding the air-fuel ratio.

4. An electronic control system according to claim 1 wherein said control unit corrects the control signal by a intake negative pressure and an engine revolution.

5. An electronic control system according to claim 1 wherein said control unit is responsive to the data regarding the air-fuel ratio to calculate the duty for control of the air-fuel ratio by the first control means of the carburetor, compares a calculation result with the predetermined value, and determines, on the basis of a comparison result, whether the first control means or the first and second control means of the carburetor control the air-fuel ratio.

6. An electronic control system according to claim 5 wherein said control unit controls the air-fuel ratio by the first control means of the carburetor when the comparison result is negative.

7. An electronic control system according to claim 6 wherein said control unit is responsive to the calculated duty to control the first control means of the carburetor when the comparison result is negative.

8. An electronic control system according to claim 5 wherein said control unit controls the air-fuel ratio by the second control means of the carburetor when the comparison result is positive.

9. An electronic control system according to claim 8 wherein said control unit is responsive to the difference between the predetermined value and the calculated duty to control the first control means of the carburetor and calculates the duty for control of the second control means when the comparison result is positive.

10. An electronic control system according to claim 8 wherein said control unit determines the duty for control of the second control means by multiplying the calculated duty by a predetermined ratio and adding a predetermined value to a resulting product.

* * * * *